US009463366B2

(12) United States Patent
Kamino

(10) Patent No.: US 9,463,366 B2
(45) Date of Patent: Oct. 11, 2016

(54) GOLF CLUB SET FITTING DEVICE, FITTING METHOD, AND COMPUTER-READABLE MEDIUM STORING FITTING PROGRAM

(71) Applicant: DUNLOP SPORTS CO. LTD., Kobe-shi, Hyogo (JP)

(72) Inventor: Kazuya Kamino, Kobe (JP)

(73) Assignee: DUNLOP SPORTS CO. LTD., Kobe-Shi (JP)

( * ) Notice: Subject to any disclaimer, the term of this patent is extended or adjusted under 35 U.S.C. 154(b) by 31 days.

(21) Appl. No.: 14/515,109

(22) Filed: Oct. 15, 2014

(65) Prior Publication Data

US 2015/0105183 A1 Apr. 16, 2015

(30) Foreign Application Priority Data

Oct. 16, 2013 (JP) ..... 2013-215796

(51) Int. Cl.

*A63B 53/00* (2015.01)
*A63B 69/36* (2006.01)
*A63B 71/06* (2006.01)

(52) U.S. Cl.

CPC ..... *A63B 60/46* (2015.10); *A63B 60/42* (2015.10); *A63B 69/36* (2013.01); *A63B 2053/005* (2013.01); *A63B 2069/3605* (2013.01); *A63B 2071/0694* (2013.01); *A63B 2220/807* (2013.01)

(58) Field of Classification Search

CPC A63B 60/46; A63B 69/36; A63B 2053/005; A63B 2069/3605; A63B 2071/0694; A63B 2220/807; A63B 60/42

See application file for complete search history.

(56) References Cited

U.S. PATENT DOCUMENTS

| | | | | |
|---|---|---|---|---|
| 6,758,759 | B2 * | 7/2004 | Gobush | A63B 24/0003 473/131 |
| 7,686,704 | B2 * | 3/2010 | Gilbert | A63B 53/00 473/290 |
| 8,360,899 | B2 | 1/2013 | Swartz et al. | |
| 8,371,962 | B2 | 2/2013 | Solheim et al. | |
| 8,444,509 | B2 * | 5/2013 | Swartz | A63B 24/0003 473/221 |
| 8,475,300 | B2 * | 7/2013 | Ueda | A63B 69/3614 473/221 |
| 8,696,495 | B2 * | 4/2014 | Galindo | A63B 57/00 473/409 |
| 8,747,246 | B2 | 6/2014 | Swartz et al. | |
| 9,192,836 | B1 * | 11/2015 | Johannesen | A63B 59/0074 |
| 2009/0088276 | A1 | 4/2009 | Solheim et al. | |
| 2010/0151956 | A1 | 6/2010 | Swartz et al. | |
| 2013/0137539 | A1 | 5/2013 | Solheim et al. | |
| 2014/0200091 | A1 | 7/2014 | Swartz et al. | |
| 2014/0221115 | A1 * | 8/2014 | Swartz | A63B 24/0006 473/219 |

FOREIGN PATENT DOCUMENTS

JP 2009-226215 A 10/2009

* cited by examiner

*Primary Examiner* — Stephen Blau
(74) *Attorney, Agent, or Firm* — Birch, Stewart, Kolasch & Birch, LLP

(57) ABSTRACT

A device is provided with an obtaining unit, a specifying unit, and a determination unit. The obtaining unit obtains measurement data in which the golfer has performed a test-hit of at least one number of a golf club for each type of golf club from among the multiple types of golf clubs. The specifying unit specifies a relationship of correspondence between a loft angle and a flight-distance for each type of golf club based on the measurement data. The determination unit determines, based on the relationship of correspondence, a type of golf club having a large flight-distance with respect to a loft angle as a best-match type, which is a type of golf club best matched to the golfer.

11 Claims, 15 Drawing Sheets

Fig.2

| wood | | | | | |
|---|---|---|---|---|---|
| number | #3 | #4 | #5 | #7 | #9 |
| loft angle[°] | 15 | 16.5 | 18 | 20 | 23 |

| utility | | | | | |
|---|---|---|---|---|---|
| number | #3+ | #3 | #4 | #5 | #6 |
| loft angle[°] | 17 | 19 | 21 | 23 | 25 |

| iron | | | | | | | | | |
|---|---|---|---|---|---|---|---|---|---|
| number | #4 | #5 | #6 | #7 | #8 | #9 | PW | AW | SW |
| loft angle[°] | 22 | 24 | 27 | 30 | 34 | 39 | 44 | 50 | 56 |

GOLF CLUB SET FITTING DEVICE, FITTING METHOD, AND COMPUTER-READABLE MEDIUM STORING FITTING PROGRAM

FIELD OF INVENTION

The present invention relates to golf club set fitting devices, fitting methods, and computer-readable media on which a fitting program is stored for assisting selection of a golf club set suited to a golfer from among multiple golf clubs of various types (categories) such as wood, utility, and iron and the like and various numbers.

BACKGROUND

There are multiple types (categories) of golf clubs such as drivers, woods, utilities, irons, and putters, and these multiple types of golf clubs are combined so as to customize a set of golf clubs suited to individual persons. A set of golf clubs is normally constituted by 14 golf clubs including five clubs as essential elements with these being one driver, one putter, and three irons referred to as a PW (pitching wedge), an AW (approach wedge), and an SW (sand wedge). The remaining nine golf clubs are then selected from among specific types of golf clubs such as woods, utilities, and irons suited to individual persons. That is, there are multiple numbered golf clubs existing in these types of golf clubs such as woods, utilities, and irons, and the user is able to freely combine from among these various types of variously numbered golf clubs, for example, with number 3 and number 5 woods, a number 3 utility, and number 4 through number 9 irons. However, the determination of which type and which number should be selected often mainly depends on intuition and it is not easy to customize a set of golf clubs.

Conventional technologies for assisting the customization of golf club sets include JP 2009-226215A (hereinafter, patent document 1) for example. This document discloses a system that, based on measurement data and the like in which a golfer has performed test-hits of golf clubs, determines a set such that desired intervals (which are uniform in some cases and non-uniform in some cases) of flight-distances are achieved according to the golf clubs included in the set, and presents this to the user. That is, in patent document 1, a golf club set is selected automatically from a perspective such that a desired distribution of flight-distances is achieved. Furthermore, patent document 1 also discloses that a golfer's preferences are comprehended from interviews and the like and inputted to the system, then used in determining the set of golf clubs. It should be noted that the golfer preferences referred to in patent document 1 include desired types and numbers of golf clubs (such as numbers of irons and woods) and club lengths for example.

However, multiple golf clubs may be present that achieve an equivalent flight-distance. For example, ordinarily woods, utilities, and irons are designed so that their loft angles are smaller and their flight-distances are extended for smaller numerical values of their respective numbers. Furthermore, although as a general tendency the flight-distances of woods are longer than the flight-distances of utilities, which are longer than the flight-distances of irons, overlapping areas also exist among these. Accordingly, although this tends not to occur within the same type of clubs, the flight-distances are frequently equivalent between different types of golf clubs such as a utility and an iron and the like. Patent document 1 does not envisage such a situation at all and does not disclose any solution in regard to what should be done in a case where golf clubs that achieve equivalent flight-distances are found when selecting golf clubs giving attention to the flight-distance. Furthermore, although the golfer's preferences are referenced in determining the golf club set in patent document 1, it eventuates that the preferences are intuition. That is, conventionally, the golfer still can only select golf clubs relying on his own or his instructor's intuition, and this makes it difficult to customize the set of golf clubs.

SUMMARY OF INVENTION

An object of the present invention is to provide a fitting device, a fitting method, and a computer-readable medium storing a fitting program that quantitatively determines which type is a best-matching type of golf club for a golfer among multiple types of golf clubs such as wood, utility, and iron, and that can assist in the selection of a golf club set suited to the golfer.

A golf club set fitting device according to a first aspect of the present invention is a fitting device for assisting selection of a golf club set suited to a golfer from among multiple types of golf clubs and includes an obtaining unit, a specifying unit, and a determination unit. The obtaining unit obtains measurement data in which the golfer has performed a test-hit of at least one number of a golf club for each type of golf club from among the multiple types of golf clubs. The specifying unit specifies a relationship of correspondence between a loft angle and a flight-distance for each type of golf club based on the measurement data. The determination unit determines, based on the relationship of correspondence, a type of golf club having a large flight-distance with respect to a loft angle as a best-match type, which is a type of golf club best matched to the golfer.

It should be noted that "specifies a relationship of correspondence between a loft angle and a flight-distance" referred to here signifies specifying information in which at least one loft angle and a flight-distance corresponding to this are associated. Furthermore, determining a "type of golf club having a large flight-distance with respect to a loft angle" as a best-match type includes determining a "type of golf club having a small loft angle with respect to a flight-distance" as a best-match type.

A golf club set fitting device according to a second aspect of the present invention is a fitting device according to the first aspect and is further provided with a decision unit. The decision unit decides a golf club that should be included in the golf club set by giving priority to the best-match type golf clubs from among the multiple types of golf clubs.

A golf club set fitting device according to a third aspect of the present invention is a fitting device according to the second aspect, wherein the specifying unit specifies the relationship of correspondence for each type of golf club based on the measurement data by specifying the flight-distances by various numbers of golf clubs having different loft angles. The decision unit, based on the relationship of correspondence, in a case where multiple golf clubs are present that give flight of an equivalent flight-distance, decides a golf club that should be included in the golf club set so that the best-match type golf club among the multiple golf clubs is given priority.

A golf club set fitting device according to a fourth aspect of the present invention is a fitting device according to any of the first to third aspects, wherein the measurement data includes data in which the golfer has performed test-hits of multiple numbers of golf clubs for a specific type of golf club. The specifying unit specifies the relationship of correspondence by performing simulation of flight-distances by various numbers of golf clubs having various loft angles so that the loft angle and the flight-distance are proportional for the specific type of golf club based on the measurement data.

A golf club set fitting device according to a fifth aspect of the present invention is a fitting device according to any of the first to third aspects, wherein the obtaining unit, in addition to the measurement data, further obtains reference data in which the golfer has performed a test-hit of a driver. The specifying unit specifies a head speed of the driver based on the reference data, and specifies the relationship of correspondence by performing simulation of flight-distances by various numbers of golf clubs having various loft angles for a specific type of golf club based on the head speed in addition to the measurement data.

A golf club set fitting device according to a sixth aspect of the present invention is a fitting device according to any of the first to fifth aspects, wherein at least two types among woods, utilities, and irons are included in the types of golf clubs.

A golf club set fitting method according to a seventh aspect of the present invention is a fitting method for assisting selection of a golf club set suited to a golfer from among multiple types of golf clubs, including a step of obtaining measurement data in which the golfer has performed a test-hit of at least one number of a golf club for each type of golf club from among the multiple types of golf clubs, a step of specifying a relationship of correspondence between a loft angle and a flight-distance for each type of golf club based on the measurement data, and a step of determining, based on the relationship of correspondence, a type of golf club having a large flight-distance with respect to a loft angle as a best-match type, which is a type of golf club best matched to the golfer.

A non-transitory computer readable medium according to an eighth aspect of the present invention is a computer readable medium storing a fitting program for assisting selection of a golf club set suited to a golfer from among multiple types of golf clubs, the program causing to be executed on a computer a step of obtaining measurement data in which the golfer has performed a test-hit of at least one number of a golf club for each type of golf club from among the multiple types of golf clubs, a step of specifying a relationship of correspondence between a loft angle and a flight-distance for each type of golf club based on the measurement data, and a step of determining, based on the relationship of correspondence, a type of golf club having a large flight-distance with respect to a loft angle as a best-match type, which is a type of golf club best matched to the golfer.

Advantageous Effect

According to the first through eight aspects, the flight-distance with respect to the loft angle is specified for each type of the multiple types of golf clubs such as wood, utility, and iron and the like. And comparisons are performed of the flight-distance with respect to the loft angle among the types of golf clubs, and the type of golf club whose flight-distance is greatest with respect to the loft angle is determined as the best-match type of the golfer. Here, in general, the golf club length becomes equivalently longer for smaller loft angles of the golf club and thus more difficult to handle. Accordingly, a large flight-distance with respect to the loft angle signifies that the flight-distance is extended regardless of the handling being difficult, and therefore here the type that achieves such a flight-distance with respect to the loft angle is determined to be the best-match type of the golfer. In other words, if there is the same level of difficulty to handle, that is, the same loft angle, the type of golf club having the most extended flight-distance is determined as the best-match. Thus, here, which of the multiple types of golf clubs such as woods, utilities, and irons and the like is a best-match for the golfer is determined quantitatively, and this can assist in the selection of a set of golf clubs suited to the golfer.

BRIEF DESCRIPTION OF DRAWINGS

FIG. 2 is a diagram that shows a list of loft angles for each number of wood, utility, and iron.

DETAILED DESCRIPTION OF THE PREFERRED EMBODIMENTS

Hereinafter, description is given regarding a golf club set fitting device, a fitting method, and a computer-readable medium storing a fitting program according to one embodiment of the present invention with reference to the accompanying drawings.

1. Overview of Golf Club Set Fitting System

Figure 1:
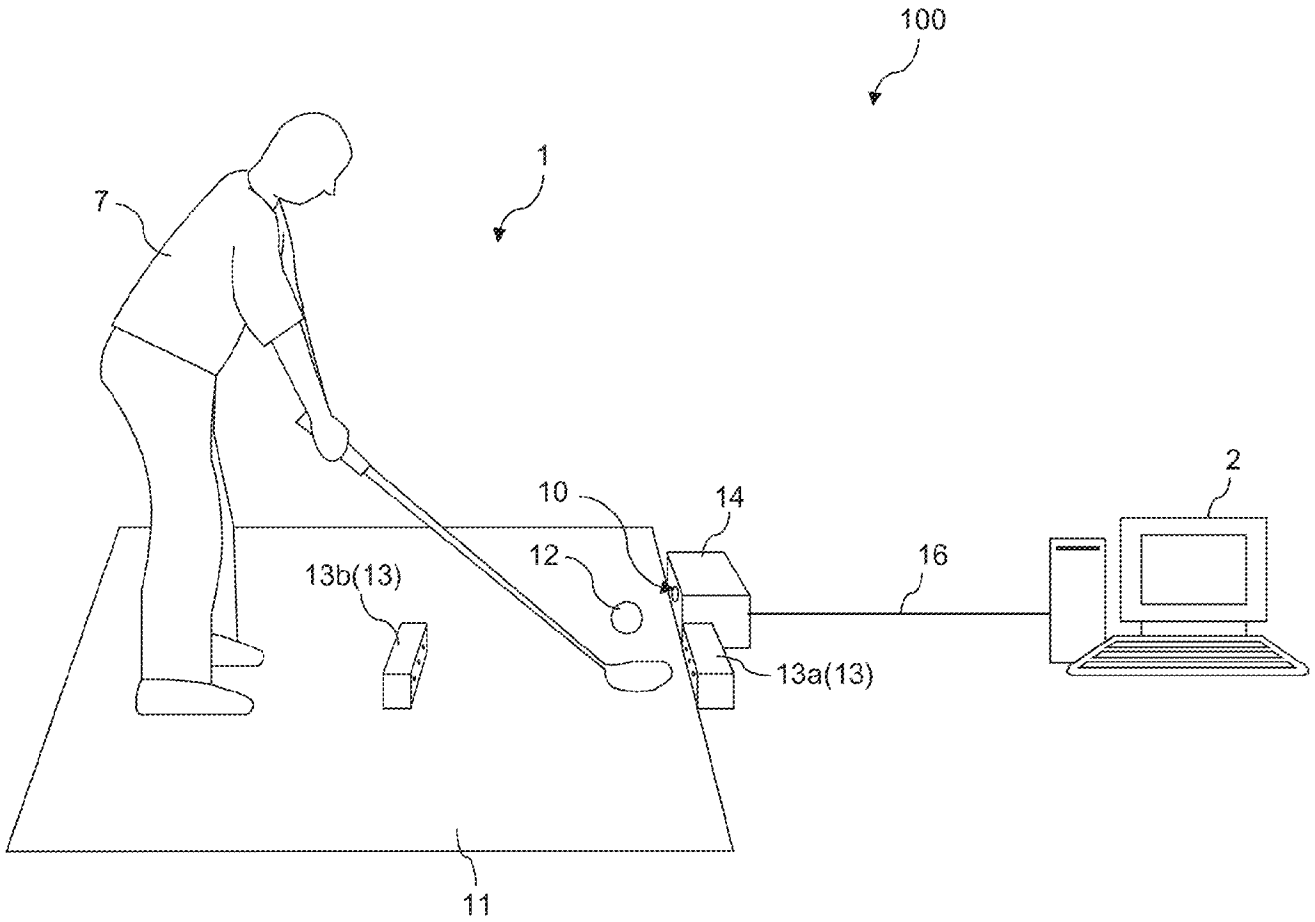
FIG. 1 is a diagram showing an overall configuration of a fitting system provided with a golf club set fitting device according to one embodiment.

FIG. 1 shows an overall configuration of a fitting system 100 provided with a golf club set fitting device 2 according to the present embodiment. The fitting device 2 is a device for assisting a golfer 7 to select, from among multiple golf clubs, a golf club set suited to himself or herself based on measurement data obtained when the golfer 7 performed test-hits with various types of golf clubs. The aforementioned measurements are carried out by a measurement system 1, and the fitting device 2 constitutes a fitting system 100 together with the measurement system 1.

In the lineup of golf clubs that can constitute a golf club set according to the present embodiment are five types of golf clubs, these being drivers, woods, utilities, irons, and putters. Five numbers of woods are present, these being numbers 3, 4, 5, 7, and 9. Five numbers of utilities are present, these being a 3+ and numbers 3 through 6. Nine numbers of irons are present, these being numbers 4 through 9 and a PW (pitching wedge), an AW (approach wedge), and an SW (sand wedge).

The number of golf clubs that the golfer 7 can place and carry in his golf bag during a round of golf is prescribed in the rules as 14 or less clubs. The fitting device 2 selects 14 or fewer golf clubs suited to the golfer 7 from the above-mentioned lineup of golf clubs. At this time, in the golf club set in the present embodiment, there are a total of nine clubs as essential elements, these being one driver, one putter, and three irons of PW, AW, and SW, and additionally four irons numbers 6 through 9. Accordingly, the fitting device 2 essentially determines a maximum of five clubs among the golf club set of 14 clubs or less. These five golf clubs are selected from among elements that are not essential elements in the above-mentioned golf club lineup, that is, from a total of 12 golf clubs, these being five woods numbered 3, 4, 5, 7, and 9, five utilities numbered 3+ and 3 through 6, and two irons numbered 4 and 5. Hereinafter, these 12 golf clubs are referred to as "selection candidate golf clubs." Although the details are described later, it should be noted that since there is sometimes a golfer 7 who desires to have two sand wedges, a maximum of four golf clubs are selected from among the 12 selection candidate golf clubs for a golfer 7 such as this.

FIG. 2 shows a list of loft angles for each number of wood, utility, and iron. As is shown in FIG. 2, the loft angle is smaller for smaller numerical values of the number for each type of wood, utility, andiron. Furthermore, these are designed such that the golf clubs are longer and the flight-distance is longer for smaller loft angles. Furthermore, although overall the loft angle of the woods, utilities, and irons becomes larger in that order, there exist overlapping areas of loft angle among the woods, utilities, and irons.

Hereinafter, after description is given regarding a configuration of the measurement system 1 and the fitting device 2, description is given regarding a flow of a fitting process by the fitting system 100.

2. Measurement System Configuration

The measurement system 1 is a system that uses camera capture to measure states in which the golfer 7 performs test-hits with various types of golf clubs. As shown in FIG. 1, in addition to a camera 10, the measurement system 1 is provided with a shot mat 11, a golf ball 12, a sensor 13, and a controller 14. The camera 10 and the sensor 13 are connected to the controller 14 via a wired or wireless communication line (not shown in drawing). Furthermore, the controller 14 is equipped with a CPU and a storage device, and after controlling the operation of the camera 10 and at least temporarily storing the image data (measurement data) captured by the camera 10, transmits this to the fitting device 2 via a wired or wireless communication line 16.

The shot mat 11 is a rectangular mat on which the golfer 7 carries out shots. The camera 10 is positioned laterally to the shot mat 11. The golf ball 12 is positioned on the shot mat 11 in front of the camera 10 so that images can be captured by the camera 10. Dot or line shaped markers or the like are applied to the golf ball 12 as appropriate to facilitate analysis of the behavior of the golf ball 12 from image data captured by the camera 10.

The sensor 13 is a sensor for achieving the timing of image-capture by the camera 10 and is provided with a light-emitting unit 13*a* and a light-receiving unit 13*b*. The light-emitting unit 13*a* is positioned near the right side of the camera 10 as viewed by a right-handed golfer 7 who is attempting to shoot while standing facing the camera 10. In the case of left-handedness, it is positioned near the left side. On the other hand, the light-receiving unit 13*b* is positioned on the shot mat 11 in front of the light-emitting unit 13*a* so as to be able to receive the light from the light-emitting unit 13*a*. It should be noted that the positions of the light-emitting unit 13*a* and the light-receiving units 13*b* may be reversed.

Then, when the golfer 7 down swings the golf club and the head or the shaft of the golf club passes between the light-emitting unit 13*a* and the light-receiving unit 13*b*, the light is blocked between the light-emitting unit 13*a* and the light-receiving unit 13*b*. The light-receiving unit 13*b* transmits a detection signal to the controller 14 immediately upon detecting this blockage. On the other hand, when the controller 14 receives the aforementioned detection signal from the light-receiving unit 13*b*, it commands the camera 10 to perform image-capture. The camera 10 is provided with a strobe function and, upon receiving an image-capture command from the controller 14, performs successive short time interval image-capture for a certain time while causing the strobe to emit light. Accordingly, at this time, multiple images are captured before and after the impact of the golf club head colliding with the golf ball 12. The camera 10 transmits the captured image data (measurement data) to the controller 14.

3. Fitting Device Configuration

Figure 3:
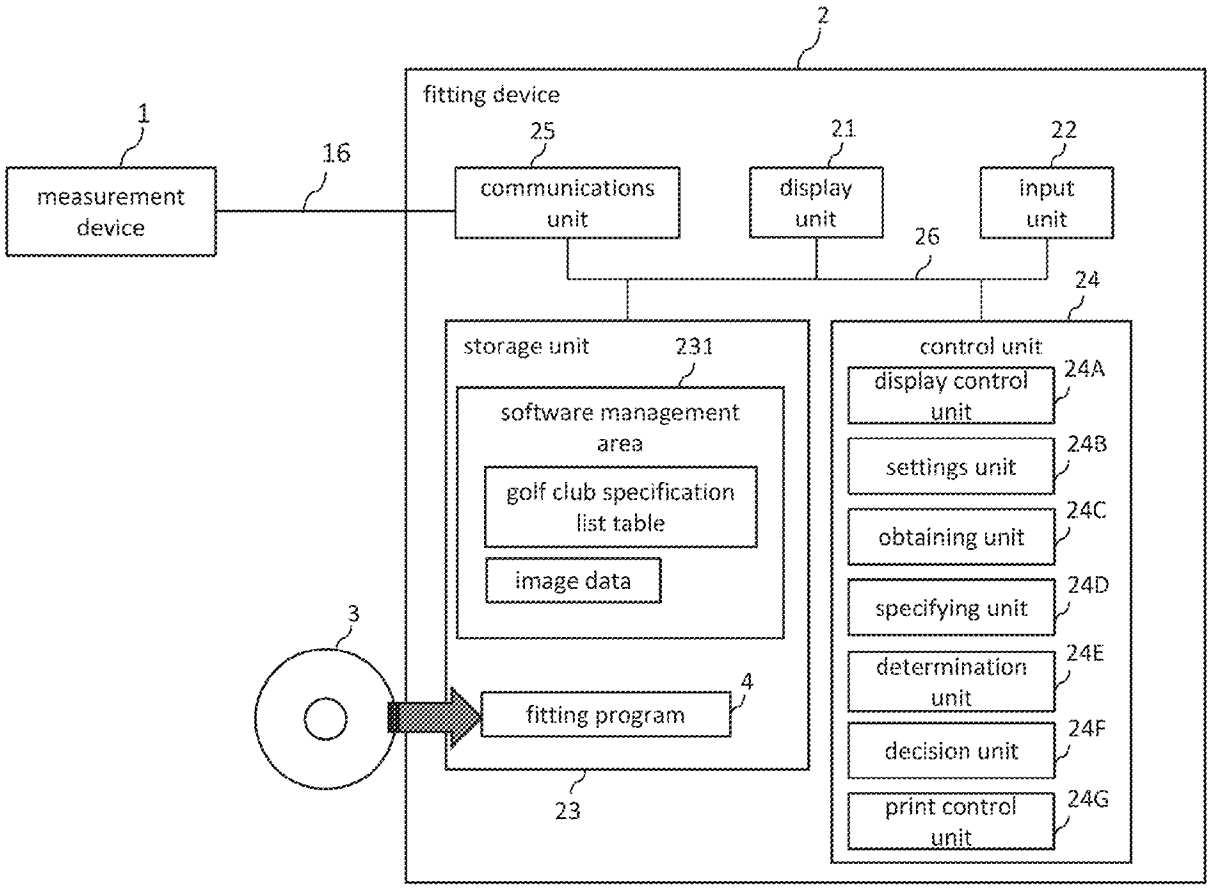
FIG. 3 is a block diagram showing a configuration of the fitting device.

FIG. 3 is a block diagram showing a configuration of the fitting device 2. The fitting device 2 is manufactured by installing a fitting program 4, which is stored on a computer-readable recording medium 3 such as a CD-ROM or a USB memory or the like, from this recording medium 3 onto a general-purpose personal computer. The fitting program 4 is software for processing image data sent from the measurement system 1 into information for assisting selection of a golf club set suited to the golfer 7. The fitting program 4 causes the fitting device 2 to operate as described below.

The fitting device 2 is provided with a display unit 21, an input unit 22, a storage unit 23, a control unit 24, and a communications unit 25. And these units 21 through 25 are mutually connected by a bus line 26 and are mutually communicable. In the present embodiment the display unit 21 can be configured using a liquid crystal display or the like and displays to a user screens and the like that are described later. It should be noted that "user" here is a collective term for any person who needs a result of fitting such as the golfer 7 himself and his instructor. Furthermore, the input unit 22 may be configured using a mouse, keyboard, or a touch panel or the like, and receives operations from the user for the fitting device 2.

The storage unit 23 may be configured using a hard disk or the like. In addition to the fitting program 4 that is stored, a software management area 231 is maintained in the storage unit 23. The software management area 231 is an area used by the fitting program 4. Also stored in the software management area 231 is a list table of specifications of woods, utilities, andirons (hereinafter, "specification list table") that includes the loft angle for each club number shown in FIG. 2. Furthermore, the image data that is sent from the measurement system 1 is saved in the software management area 231.

The control unit 24 may be configured from a CPU, ROM, and a RAM or the like. By reading out and executing the fitting program 4 in the storage unit 23, the control unit 24 operates virtually as a display control unit 24A, a settings unit 24B, an obtaining unit 24C, a specifying unit 24D, a determination unit 24E, a decision unit 24F, and a print control unit 24G as shown in FIG. 1. Details of the operations of each of the units 24A to 24G are described later.

The communications unit 25 functions as a communications interface that receives data from external storage devices such as the storage device of the measurement system 1 via the communication line 16. Furthermore, the communications unit 25 can connect the fitting device 2 to printers and plotters and the like, which are not shown in the drawings. Accordingly, results of fitting, which are described later, can be output from any of these printers or plotters or the like via the communications unit 25 by the print control unit 24G.

4. Flow of Fitting Processing

Figure 4:
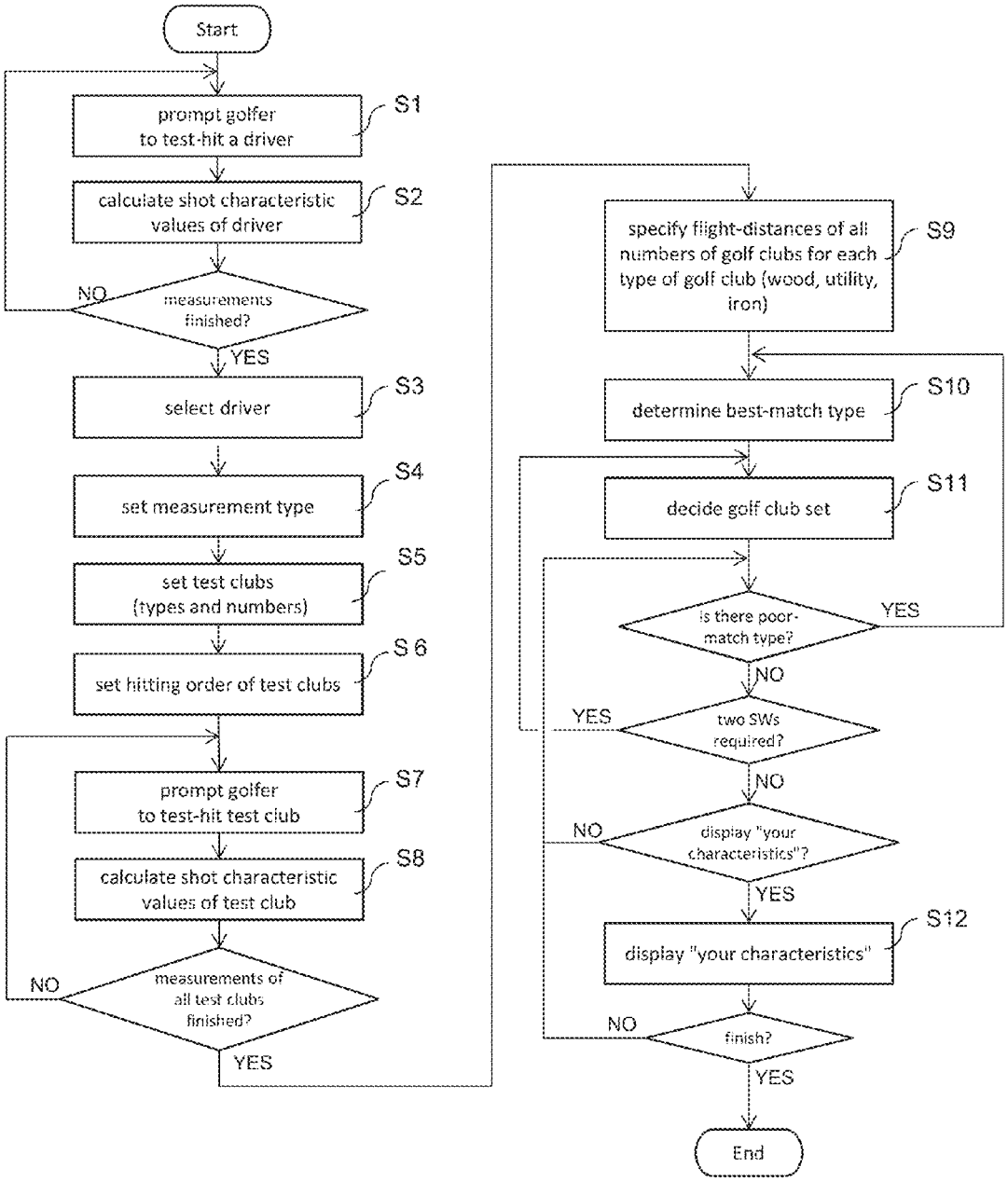
FIG. 4 is a flowchart showing a flow of a fitting process.

Hereinafter, description is given regarding a flow of a fitting process by the fitting system 100 with reference to FIG. 4.

First, upon desiring to select a golf club set from among the aforementioned golf club lineup, the user appropriately operates the input unit 22 to activate the fitting program 4 on the fitting device 2. This starts the fitting process shown in FIG. 4.

Figure 5:
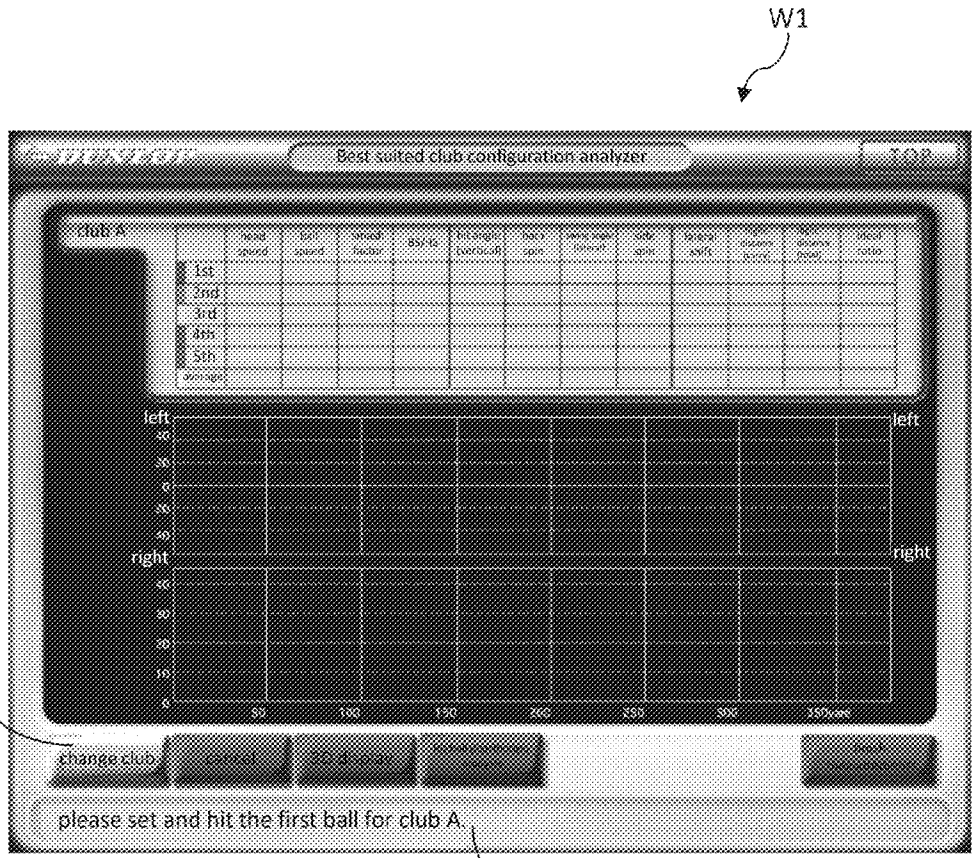
FIG. 5 is a diagram showing a screen at a time of test-hitting a driver.

First, as step S1, a screen W1 as shown in FIG. 5 is displayed on the display unit 21. It should be noted that all display of the various screens onto the display unit 21 is controlled by the display control unit 24A. A message is displayed in an area A1 at the bottom of the screen W1 prompting the golfer 7 to test-hit a driver. When the golfer 7 performs a test-hit of the driver according to the prompt, images of that state, in particular around the golf ball 12 before and after impact, are successively captured by the camera 10. This image data is transmitted from the camera 10 through the controller 14 to the fitting device 2. The obtaining unit 24C obtains the image data and saves it in a specific directory inside the software management area 231 so that it can be referenced later by the specifying unit 24D.

Next, at step S2, the specifying unit 24D calculates various parameter values that express characteristics of a golf club shot (hereinafter referred to as "shot characteristic values") by performing image processing on the image data in the software management area 231. Specifically, these parameters include such items as a speed of the golf club head (head speed), a speed of the golf ball 12 (ball speed), a backspin exerted on the golf ball 12, a side-spin rotation velocity, and the flight-distance of the golf ball 12. Furthermore, although both the carry and the total are calculated for the flight-distance, when simply flight-distance is referred to in the present embodiment, it signifies the total flight-distance, unless specifically noted otherwise. It should be noted that since various publicly known methods are available as methods for calculating shot characteristic values based on the aforementioned image data, detailed description of this is omitted here.

Figure 6:
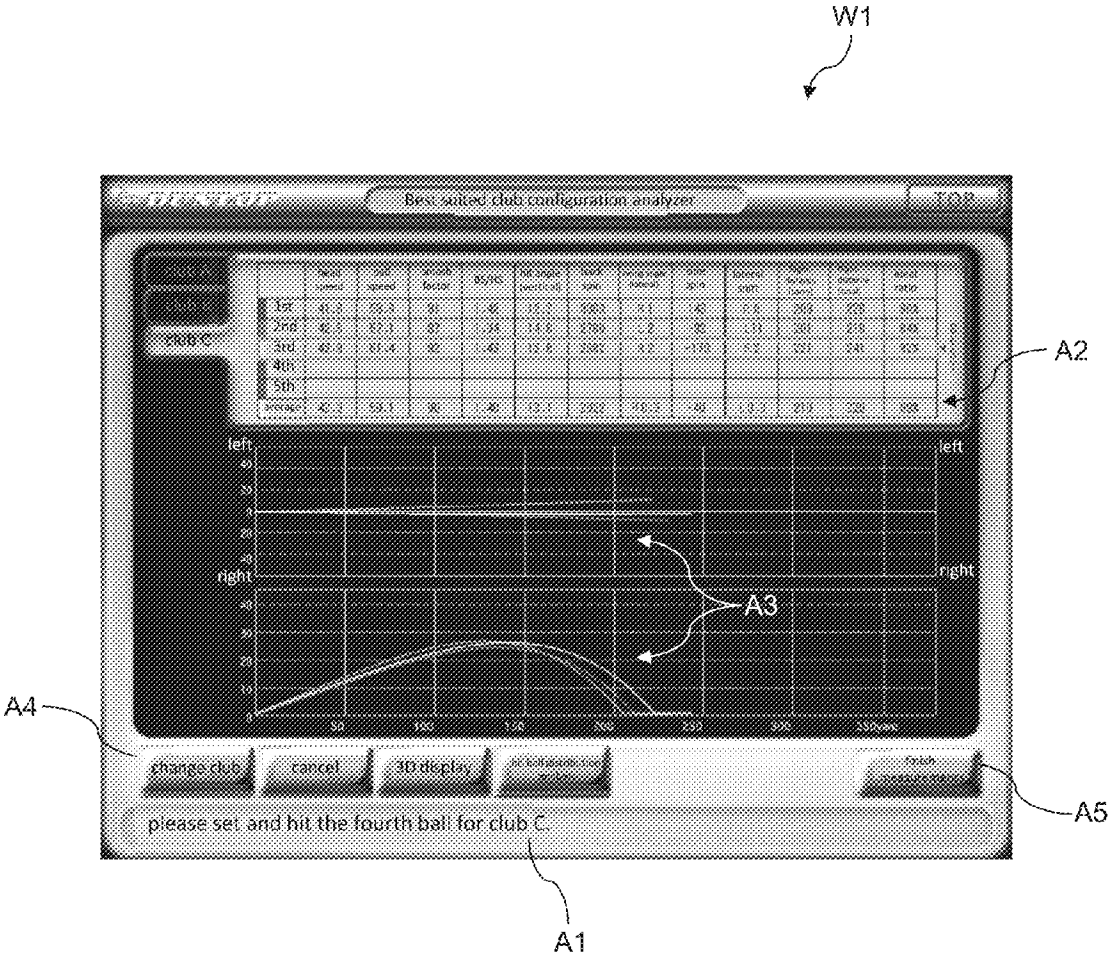
FIG. 6 is a diagram showing a different screen at a time of test-hitting a driver.

Furthermore, at step S2, the display control unit 24A displays on the screen W1 a list A2 of the shot characteristic values calculated by the specifying unit 24D (see FIG. 6). It should be noted that to improve the accuracy of the shot characteristic value simulations, the golfer 7 is able to perform test-hits of the same driver multiple times. In this case, an average value of the shot characteristic values of all the test-hits is calculated by the specifying unit 24D, but in addition to this average value, the shot characteristic value of each shot is also displayed in the list A2 as shown in FIG. 6. Furthermore, the specifying unit 24D performs simulation of the trajectory of the golf ball 12 according to each test-hit, and the display control unit 24A displays a two-dimensional or three-dimensional graphic of this trajectory on an area A3 of the screen W1.

It should be noted that the aforementioned steps S1 and S2 may be repeated multiple times as required for different drivers. In a case where these are repeated multiple times, the user may press a "change club" button A4 on the screen W1. In this way, the fitting device 2 is capable of repetitively executing steps S1 and S2. On the other hand, in a case where steps S1 and S2 are brought to a finish after steps S1 and S2 are finished for at least one driver, the user presses a "measurements finished" button A5 on the screen W1. It should be noted that FIG. 6 shows the screen W1 as it is during measurements for a third golf club.

Figure 7:
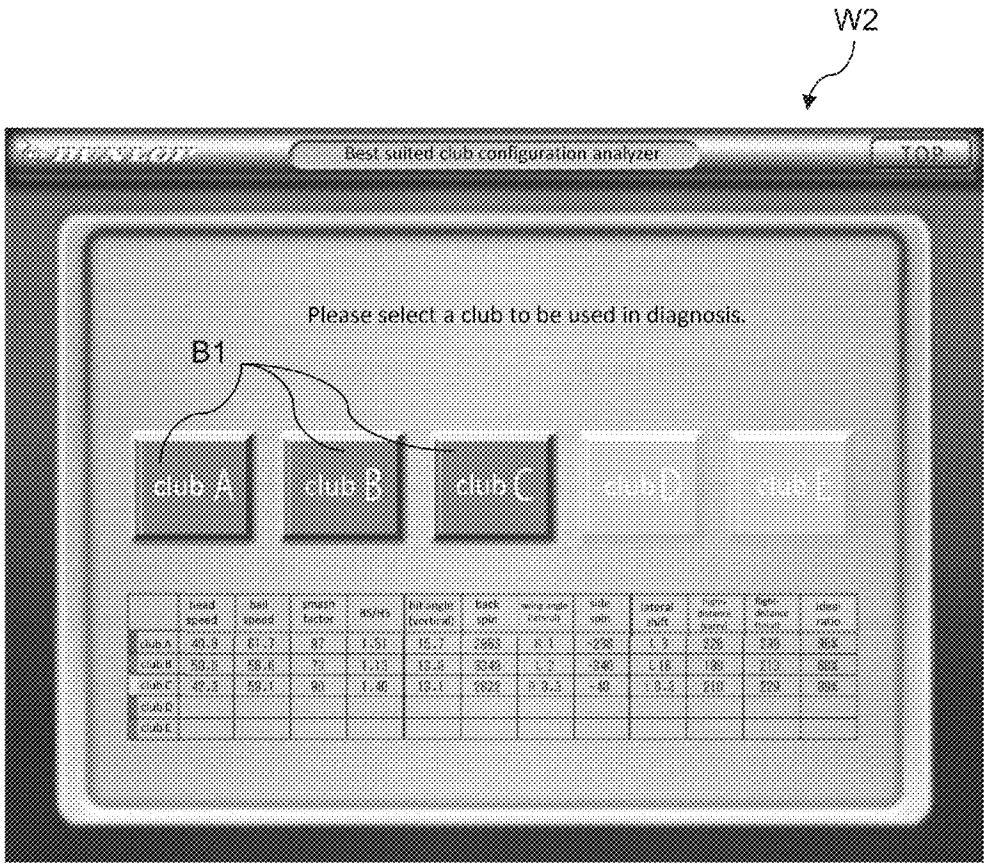
FIG. 7 is a diagram showing a screen for selecting a driver to be used in diagnosis.

When steps S1 and S2 are finished, step S3 is executed. At step S3, the settings unit 24B receives a selection of a driver to be used in diagnosis via a screen W2 as shown in FIG. 7. That is, in a case where steps S1 and S2 are repeated multiple times for multiple drivers, the user selects one driver suited for use in diagnosis from the feel of the hit and the shot characteristic values that have been obtained. On the screen W2, buttons B1 are displayed corresponding respectively to the drivers for which a test-hit has been performed, and the user can input to the fitting device 2 a selection of a specific driver by pressing one of these buttons B1. It should be noted that in a case where steps S1 and S2 are executed once only, the screen W2 may display only a single button B1 or step S3 may be omitted.

Figure 8:
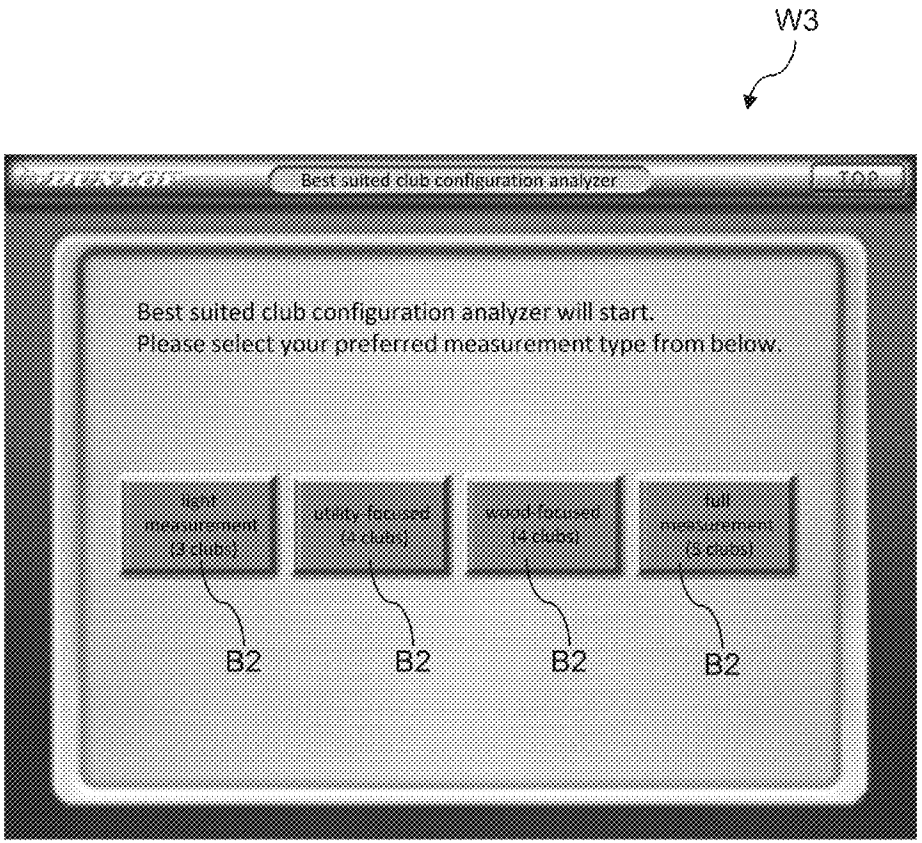
FIG. 8 is a diagram showing a screen for setting the type of measurement.

Next, at step S4, the settings unit 24B receives input of a measurement type via a screen W3 as shown in FIG. 8. In the present embodiment, there are four types of measurements, these being a light measurement, a utility-focused measurement, a wood-focused measurement, and a full measurement. A light measurement is a measurement in which a test-hit is performed for one each of the woods, utilities, and irons. Furthermore, a utility-focused measurement is a measurement in which a test-hit is performed for two utilities (of different numbers), one wood, and one iron. A wood-focused measurement is a measurement in which a test-hit is performed for two woods (of different numbers), one utility, and one iron. A full measurement is a measurement in which a test-hit is performed for two woods (of different numbers), two utilities (of different numbers), and one iron. On the screen W3, buttons B2 are displayed corresponding respectively to the aforementioned types of measurements, and the user can input to the fitting device 2 a type of measurement by pressing one of these buttons B2.

Figure 9:
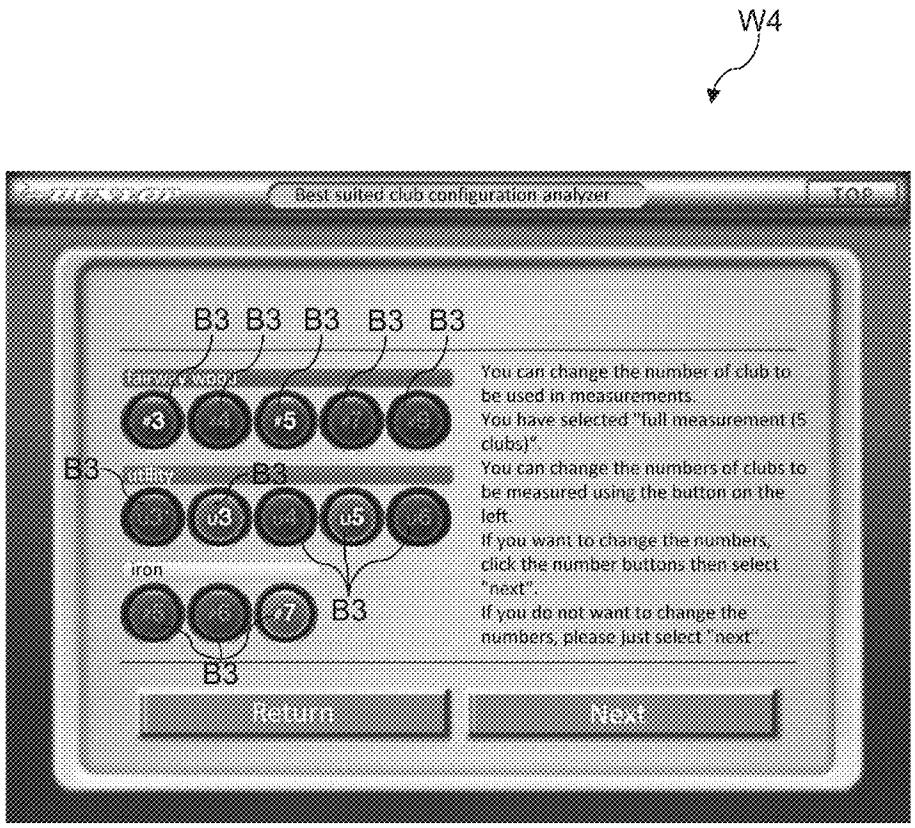
FIG. 9 is a diagram showing a screen for setting the numbers of the test clubs.

Next, at step S5, the settings unit 24B receives input of the type and number of golf club to be used in diagnosis from the golf club group including woods, utilities, and irons via a screen W4 as shown in FIG. 9. On the screen W4, buttons B3 are displayed corresponding respectively to the aforementioned golf club groups, and the user can input to the fitting device 2 a combination of golf clubs to be used in diagnosis by pressing the appropriate buttons B3. It should be noted that the buttons B3 on the screen W4 are designed such that only combinations in line with the types of measurements selected at step S4 can be pressed. For example, FIG. 9 is a screen for a case in which a full measurement has been selected and, in this case, only combinations of buttons B3 corresponding to two woods, two utilities, and one iron can be pressed. Hereinafter, the golf clubs selected at step S5 are referred to as test clubs.

Figure 10:
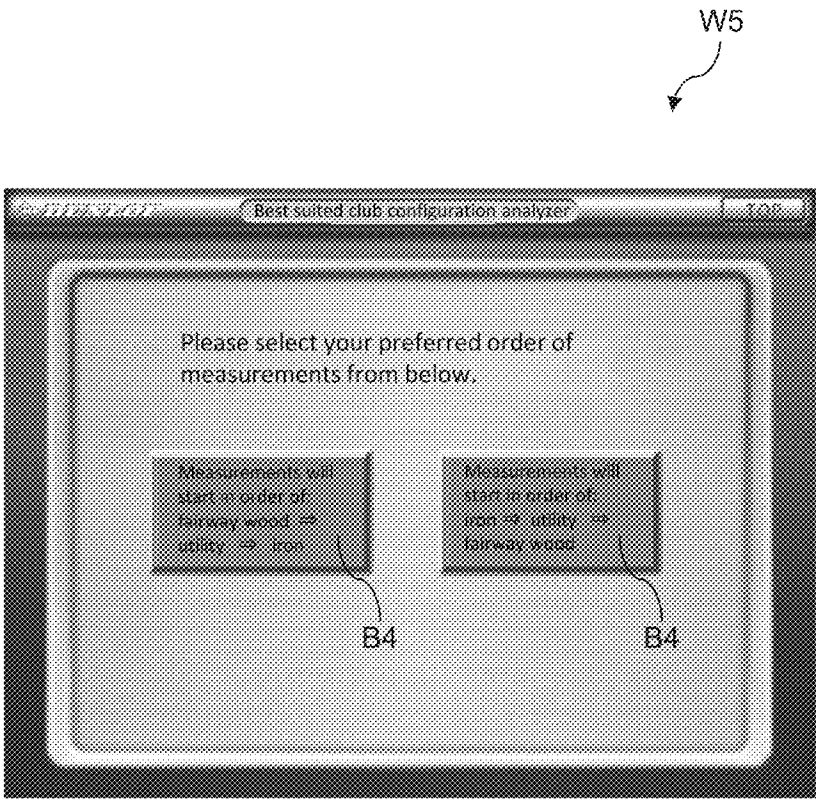
FIG. 10 is a diagram showing a screen for setting the hitting order of the test clubs.

Next, at step S6, the settings unit 24B receives input of a hitting order of the test clubs via a screen W5 as shown in FIG. 10. In the present embodiment, it is not possible to hit randomly with multiple test clubs. That is, the fitting device 2 prompts the golfer 7 to perform test-hits in an order of woods from smaller to larger numbers, utilities from smaller to larger numbers, and irons from smaller to larger numbers, or an order that is opposite to this. This is to improve the data reproducibility of measurement data obtained according to test-hits of test clubs (more accurately, the shot characteristic values obtained from measurement data). Accordingly, as shown in FIG. 10, two buttons B4 are displayed on the screen W5 corresponding to the aforementioned two types of hitting orders respectively, and the user can input to the fitting device 2 the hitting order of test clubs by pressing one of these buttons B4.

Following this, steps S7 and S8 are repetitively executed steps for each test club. The order of repetition is the hitting order of test clubs selected at step S6. In steps S7 and S8, the same processing as steps S1 and S2 is executed for the test club that is currently selected.

Figure 11:
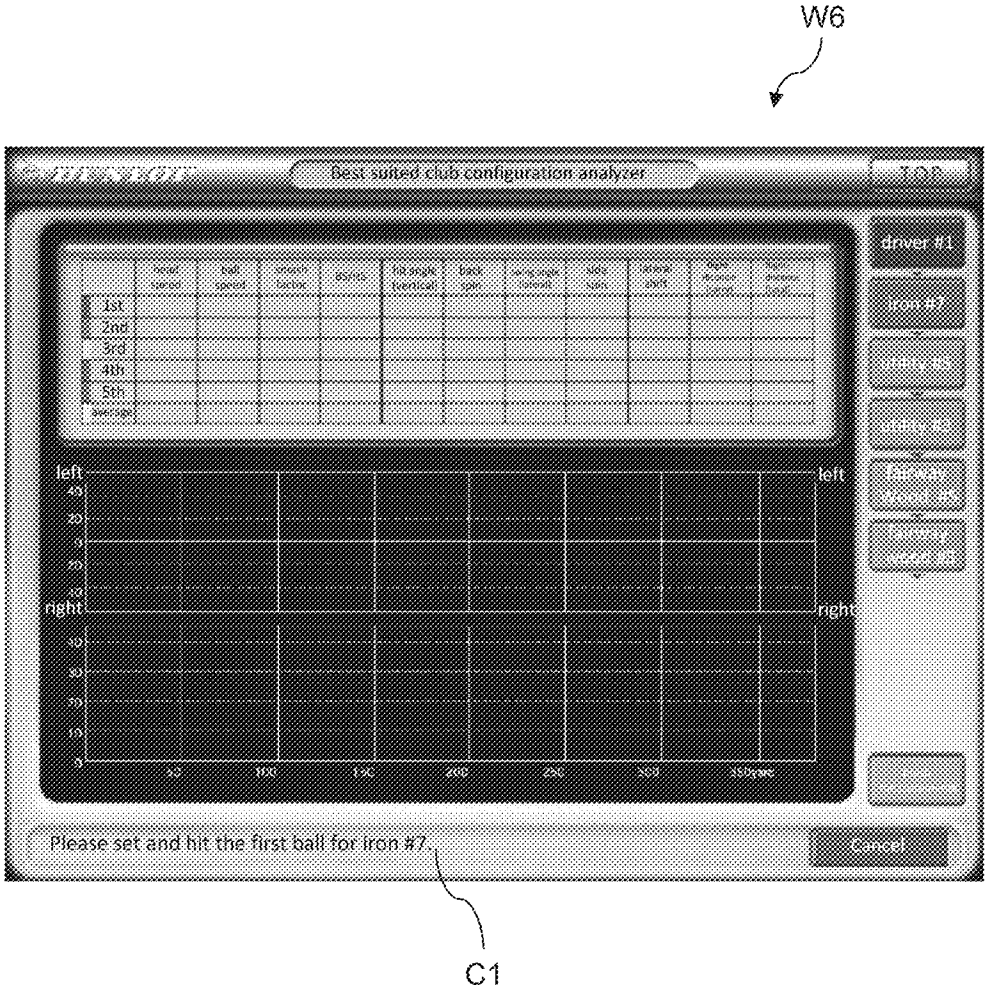
FIG. 11 is a diagram showing a screen at a time of test-hitting a test club.

That is, first, at step S7, a screen W6 as shown in FIG. 11 is displayed on the display unit 21. A message is displayed in an area C1 at the bottom of the screen W6 prompting the golfer 7 to test-hit the currently selected test club. And when the golfer 7 performs a test-hit of this test club according to the prompt, images of that state, in particular around the golf ball 12 before and after impact, are successively captured by the camera 10. This image data is transmitted from the camera 10 through the controller 14 to the fitting device 2. The obtaining unit 24C obtains the image data and saves it in a specific directory inside the software management area 231 so that it can be referenced later as necessary by the specifying unit 24D.

Next, at step S8, the specifying unit 24D calculates shot characteristic values for this test club by performing image processing on the image data in the software management area 231 relating to the currently selected test club.

Figure 12:
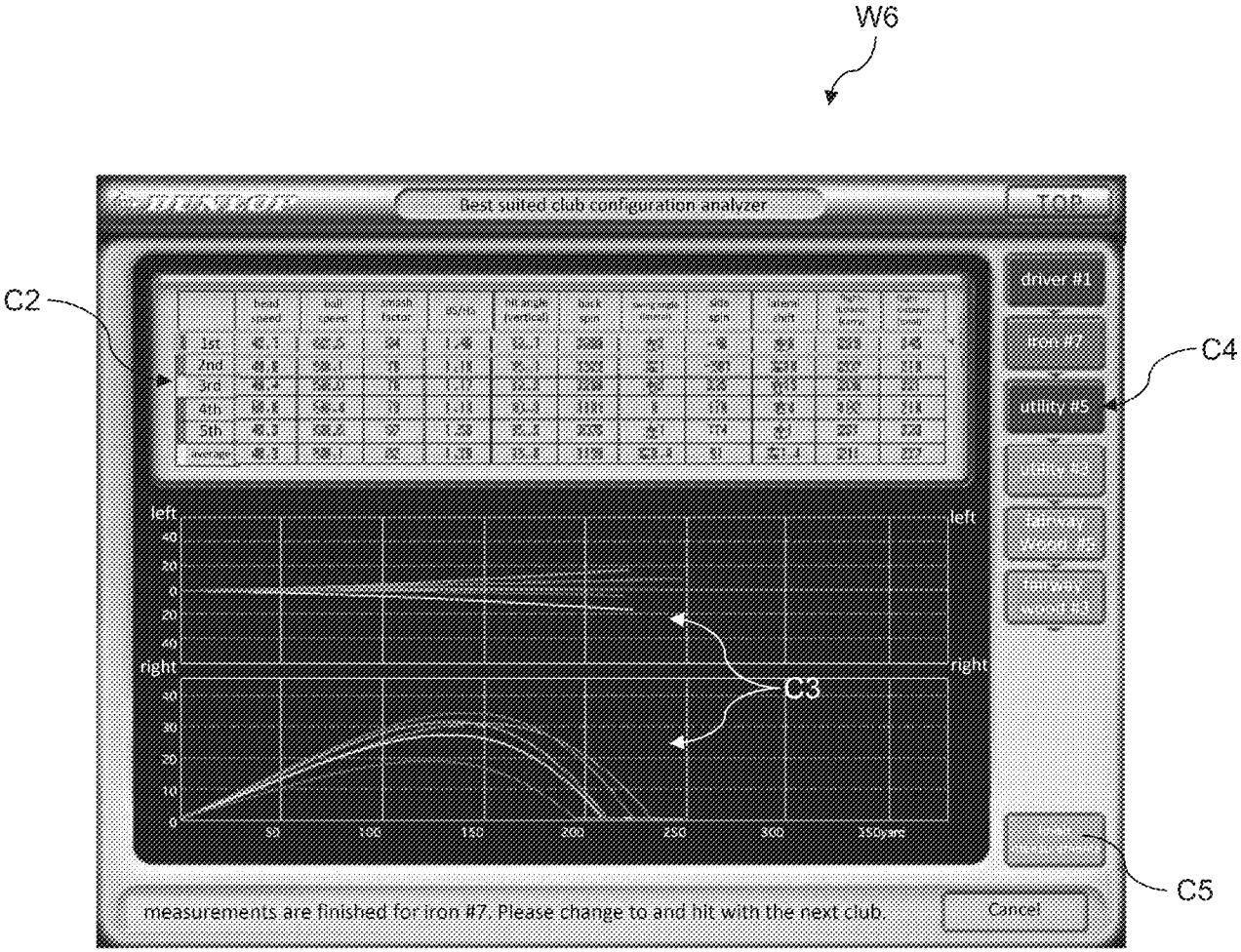
FIG. 12 is a diagram showing another screen at a time of test-hitting a test club.

Furthermore, at step S8, the display control unit 24A displays on the screen W6 a list C2 of the shot characteristic values for the currently selected test club calculated by the specifying unit 24D (see FIG. 12). It should be noted that to improve the accuracy of the shot characteristic value simulations, the golfer 7 is able to perform test-hits of the same test club multiple times. In this case, an average value of the shot characteristic values of all the test-hits is calculated by the specifying unit 24D, but in addition to this average value, the shot characteristic value of each shot is also displayed in the list C2 as shown in FIG. 12. Furthermore, the specifying unit 24D performs simulation of the trajectory of the golf ball 12 according to each test-hit, and the display control unit 24A displays a two-dimensional or three-dimensional graphic of this trajectory on an area C3 of the screen W6.

It should be noted that in a case of transitioning to measurements of the next test club, the user may press a button C4 corresponding to the next test club displayed on the screen W6. In this way, the fitting device 2 is capable of repetitively executing steps S7 and S8 for the next test club. On the other hand, in a case where steps S7 and S8 are finished for all the test clubs, the user presses a "measurements finished" button C5 on the screen W6.

When steps S7 and S8 are finished for all the test clubs, step S9 is executed. At step S9, the specifying unit 24D performs simulation to calculate the flight-distances for all the selection candidate golf clubs. The shot characteristic values calculated up to this point and the specification list table in the storage unit 23 are referenced in these simulations.

First, description is given of a flight-distance simulation method for irons. Here, the specifying unit 24D specifies the flight-distances by all numbers of irons, which have different loft angles. Specifically, from the specification list table in the storage unit 23, the specifying unit 24D reads out a loft angle $L_I$ of the iron test club (hereinafter, "test iron") and also reads out a loft angle $L_{I\text{-}N}$ of each number N other than the test iron. Furthermore, based on calculation results at steps S2 and S8, the specifying unit 24D specifies a head speed $S_D$ for the driver (hereinafter, "driver head speed") and a flight-distance $d_I$ according to the test iron. Then, flight-distances $d_{I\text{-}N}$ of numbers N other than the test iron are calculated in accordance with the following expression 1.

When $S_D$ is high-speed (for example, $S_D \geq 42.5$ m/s),

For all numbers:

$$d_{I\text{-}N}=a_1(L_{I\text{-}N}-L_I)+d_I \quad \text{(Expression 1)}$$

When $S_D$ is mid-speed (for example, 42.5 m/s$>S_D\geq$37.5 m/s),

For number 6 or higher, PW, AW, and SW numbers:

$$d_{I\text{-}N}=a_1(L_{I\text{-}N}-L_I)+d_I$$

For number 5 or lower numbers:

$$d_{I\text{-}N}=a_2(L_{I\text{-}N}-L_I)+d_I$$

When $S_D$ is low-speed (for example, $S_D$ 37.5 m/s),

For number 6 or higher, PW, AW, and SW numbers:

$$d_{I\text{-}N}=a_1(L_{I\text{-}N}-L_I)+d_I$$

For number 5 or lower numbers:

$$d_{I\text{-}N}=a_3(L_{I\text{-}N}-L_I)+d_I$$

Here, $a_1$ is a constant that is proportional to $S_D$ and is calculated from $S_D$. Furthermore, $a_2$ and $a_3$ are constants that are gained by multiplying $a_1$ by respective predetermined values smaller than 1, such that $|a_2|>|a_3|$.

Expression 1 is based on the knowledge that the flight-distance of the golf ball 12 is generally proportional to the loft angle. Furthermore, expression 1 is based on the knowledge that this proportional relationship is somewhat diminished when the head speed becomes slower, and that for certain numbers and below (this is number 5 and lower in the above example, but this is also sometimes other than number 5, for example, number 6 or lower), the gradient (flight-distance/loft angle) becomes gentler.

Next, description is given of a flight-distance simulation method for woods. Here, the specifying unit 24D specifies the flight-distances by all numbers of woods, which have different loft angles. It should be noted that the calculation method is different for a case in which there is one wood test club (hereinafter, "test wood") (the light measurement and the utility-focused measurement) and a case in which there are two test woods (the wood-focused measurement and the full measurement). These methods are described below in order.

First, in a case where there is one test wood, the specifying unit 24D reads out a loft angle $L_W$ of the test wood from the specification list table in the storage unit 23 and also reads out a loft angle $L_{W\text{-}N}$ of each number N other than the test wood. Furthermore, based on calculation results at steps S2 and S8, the specifying unit 24D specifies the driver head speed $S_D$ and a flight-distance $d_W$ according to the test wood. Then, flight-distances $d_{W\text{-}N}$ of numbers N other than the test wood are calculated in accordance with the following expression 2.

For all numbers:

$$d_{W\text{-}N}=a_4(L_{W\text{-}N}-L_W)+d_W \quad \text{(Expression 2)}$$

Here, $a_4$ is a constant that is proportional to $S_D$ and is calculated from $S_D$. Expression 2 is also based on the knowledge that the flight-distance of the golf ball 12 is generally proportional to the loft angle.

On the other hand, in a case where there are two test woods, the specifying unit 24D reads out loft angles $L_{W1}$ and $L_{W2}$ of the two test woods respectively from the specification list table in the storage unit 23 and also reads out the loft angle $L_{W\text{-}N}$ of each number N other than the test woods. Furthermore, based on calculation results at step S8, the specifying unit 24D specifies the flight-distances $d_{W1}$ and $d_{W2}$ according to the two test woods. Then, flight-distances $d_{W\text{-}N}$ of numbers N other than the test woods are calculated in accordance with the following expression 3.

For all numbers:

$$d_{W\text{-}N}=a_5(L_{W\text{-}N}-L_W)+d_W \quad \text{(Expression 3)}$$

Here, $a_5$ is a constant and is calculated in accordance with the following expression 4. Furthermore, $L_W$ is either one of $L_{W1}$ or $L_{W2}$ or an average thereof, and $d_W$ is also either one of $d_{W1}$ or $d_{W2}$ or an average thereof. Expressions 3 and 4 are also based on the knowledge that the flight-distance of the golf ball 12 is generally proportional to the loft angle.

$$a_5=(d_{W1}-d_{W2})/(L_{W1}-L_{W2}) \quad \text{(Expression 4)}$$

Next, description is given of a flight-distance simulation method for utilities. Here, the specifying unit 24D specifies the flight-distances by all numbers of utilities, which have different loft angles. It should be noted that, as shown below, the flight-distance simulation method for utilities is similar to the case of woods. Thus, similarly, the calculation method is different for a case in which there is one utility test club (hereinafter, "test utility") (the light measurement and the wood-focused measurement) and a case in which there are two test utilities (the utility-focused measurement and the full measurement).

That is, in a case where there is one test utility, the specifying unit 24D reads out a loft angle $L_U$ of the test utility from the specification list table in the storage unit 23 and also reads out a loft angle $L_{U\text{-}N}$ of each number N other than the test utility. Furthermore, based on calculation results at steps S2 and S8, the specifying unit 24D specifies the driver head speed $S_D$ and a flight-distance $d_U$ according to the test utility. Then, flight-distances $d_{U\text{-}N}$ of numbers N other than the test utility are calculated in accordance with the following expression 5.

For all numbers:

$$d_{U\text{-}N}=a_6(L_{U\text{-}N}-L_U)+d_U \quad \text{(Expression 5)}$$

Here, $a_6$ is a constant that is proportional to $S_D$ and is calculated from $S_D$. Expression 5 is also based on the knowledge that the flight-distance of the golf ball 12 is generally proportional to the loft angle.

On the other hand, in a case where there are two test utilities, the specifying unit 24D reads out loft angles $L_{U1}$ and $L_{U2}$ of the two test utilities respectively from the specification list table in the storage unit 23 and also reads out a loft angle $L_{U\text{-}N}$ of each number N other than the test utilities. Furthermore, based on calculation results at step S8, the specifying unit 24D specifies the flight-distances $d_{U1}$ and $d_{U2}$ for the two test utilities respectively. Then, flight-distances $d_{U\text{-}N}$ of numbers N other than the test utilities are calculated in accordance with the following expression 6.

For all numbers:

$$d_{U\text{-}N}=a_7(L_{U\text{-}N}-L_U)+d_U \quad \text{(Expression 6)}$$

Here, $a_7$ is a constant and is calculated in accordance with the following expression 7. Furthermore, $L_U$ is either one of $L_{U1}$ or $L_{U2}$ or an average thereof, and $d_U$ is also either one of $d_{U1}$ or $d_{U2}$ or an average thereof. Expressions 6 and 7 are also based on the knowledge that the flight-distance of the golf ball 12 is generally proportional to the loft angle.

$$a_7=(d_{U1}-d_{U2})/(L_{U1}-L_{U2}) \quad \text{(Expression 7)}$$

When step S9 is finished, step S10 is executed. At step S10, the determination unit 24E determines which type of the woods, utilities, and irons are best-matches for the golfer 7. Specifically, based on the calculation result of step S9, the determination unit 24E determines that the type for which the flight-distance is greater with respect to the loft angle is the type that is the better match for the golfer 7.

In the present embodiment, the determination unit 24E compares the flight-distances with respect to the same loft angle among the three types, these being woods, utilities, and irons, then determines that the type that beats the other two is the best-match type (the no. 1 type), the type that beats one other is the second best-match type (no. 2 type), and the type that beats none of the others is the third best-match type (no. 3 type). It should be noted that, as shown in FIG. 2, among the woods, utilities, and irons of the present embodiment there is none present that have completely the same loft angle, and therefore the loft angles are weighted and compared in accordance with (1) to (3) below.

(1) which is greater between $(d_{W\text{-}5}+d_7)/2$ and $d_{U\text{-}3}$ (2) which is greater between $d_{W\text{-}9}$ and $(d_{I\text{-}4}+d_{I\text{-}5})/2$ (3) which is greater between $(d_{U\text{-}5}+d_{U\text{-}6})/2$ and $d_{I\text{-}5}$ Following this, at step S11, the decision unit 24F decides a golf club set so that the better-match type of golf clubs for the golfer 7 from among the selection candidate golf clubs are given priority. Specifically, the decisions are preformed according to a following procedure.

As described earlier, a driver as well as irons from number 6 to SW are included as essential elements in a golf club set. And when data of the flight-distances of these essential elements are arranged in order, a blank area occurs between the flight-distance $d_D$ of the driver and the flight-distance $d_{I\text{-}6}$ of the number 6 iron. Accordingly, it is preferable that golf clubs other than these essential elements are selected so as to fill in this blank area for flight-distance as evenly as possible.

Consequently, first, the decision unit 24F establishes the golf club with the greatest distance other than the driver (hereinafter, "long distance club," which is normally a number 3 wood) as a club to be included in the golf club set. Accordingly, at this time point, there are four remaining golf clubs that are not established. Next, based on the calculation results of step S9, the decision unit 24F calculates a blank area length $d_b-d_{I\text{-}6}$ between the flight-distance $d_b$ of the long distance club and the flight-distance $d_{I\text{-}6}$ of the number 6 iron, divides this by five, which is one added to four, which is the number of golf clubs that are not established, and sets this as an inter-number flight-distance. Then the decision unit 24F progressively adds the inter-number flight-distance in order to the flight-distance $d_{I\text{-}6}$ the same number of times as the number of golf clubs that are not established (that is, four times). Hereinafter, the four values that are obtained at this time are referred to as "ideal distances."

Figure 15:
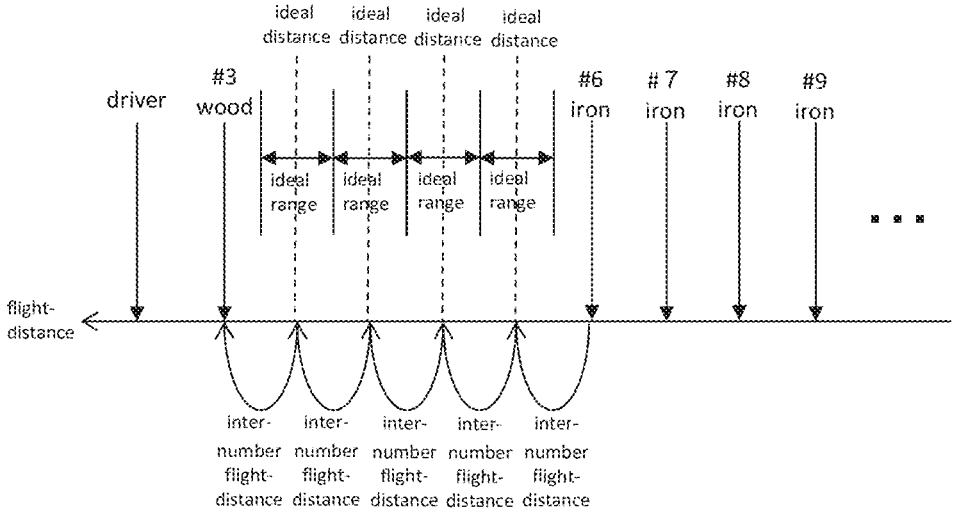
FIG. 15 is a conceptual diagram that shows ideal ranges of flight-distances for selection candidate golf clubs.

The decision unit 24F defines ideal ranges (see FIG. 15) that are centered on the ideal distances. It should be noted that the width of the ideal range is equal to the inter-number flight-distance and is uniform. And, of the selection candidate golf clubs, all the numbers of golf clubs of the no. 1 type are sorted in the ideal ranges as much as possible based on the flight-distance calculated at step S9. Then, the decision unit 24F decides all the numbers of golf clubs sorted into the ideal ranges as clubs to be included in the golf club set. It should be noted that in a case where multiple numbers of golf clubs are within the same ideal range, the golf club number having the closest flight-distance to the ideal distance is given priority and included in the set.

Following this, in a case where an ideal range is present that does not include a golf club according to the aforementioned processing, the decision unit 24F investigates including a no. 2 type golf club in the set. That is, the decision unit 24F sorts all the numbers of golf clubs of the no. 2 type of the selection candidate golf clubs into the still open ideal ranges as much as possible based on the flight-distance calculated at step S9. It should be noted that in a case where multiple numbers of golf clubs are within the same ideal range, the golf club number whose flight-distance is closest to the ideal distance is given priority and included in the set. However, at this time, the following filtering is carried out to avoid having a different type of golf club interposed between same type golf clubs when the golf clubs included in the golf club set are arranged in order of their flight-distances. That is, only a no. 2 golf club that satisfies any one of the following conditions can be included in the set of golf clubs.

(1) A golf club whose flight-distance is longer than the golf club having the longest flight-distance among the no. 1 type golf clubs that are already decided as being included in the golf club set.

(2) A golf club whose flight-distance is shorter than the golf club having the shortest flight-distance among the no. 1 type golf clubs that are already decided as being included in the golf club set.

Following this, in a case where an ideal range is present that still does not include a golf club even though the sorting of no. 2 types has finished, the decision unit 24F investigates including a no. 3 type golf club in the set. That is, the decision unit 24F sorts all the numbers of golf clubs of the no. 3 type of the selection candidate golf clubs into the still open ideal ranges as much as possible based on the flight-distance calculated at step S9. It should be noted that in a case where multiple numbers of golf clubs are within the same ideal range, the golf club number having the closest flight-distance to the ideal distance is given priority and included in the set. However, at this time, the following filtering is carried out to avoid having a different type of golf club interposed between same type golf clubs when the golf clubs included in the golf club set are arranged in order of their flight-distances. That is, only a no. 3 golf club that satisfies any one of the following conditions can be included in the set of golf clubs.

(1) A golf club whose flight-distance is longer than the golf club having the longest flight-distance among the no. 1 and no. 2 type golf clubs that are already decided as being included in the golf club set.

(2) A golf club whose flight-distance is shorter than the golf club having the shortest flight-distance among the no. 1 and no. 2 type golf clubs that are already decided as being included in the golf club set.

It should be noted that sometimes a result of the aforementioned filtering is that all the ideal ranges are not filled, but in this case the ideal distance is set as the blank area as it is. In this case, the set of golf clubs is less than 14 clubs.

Figure 13:
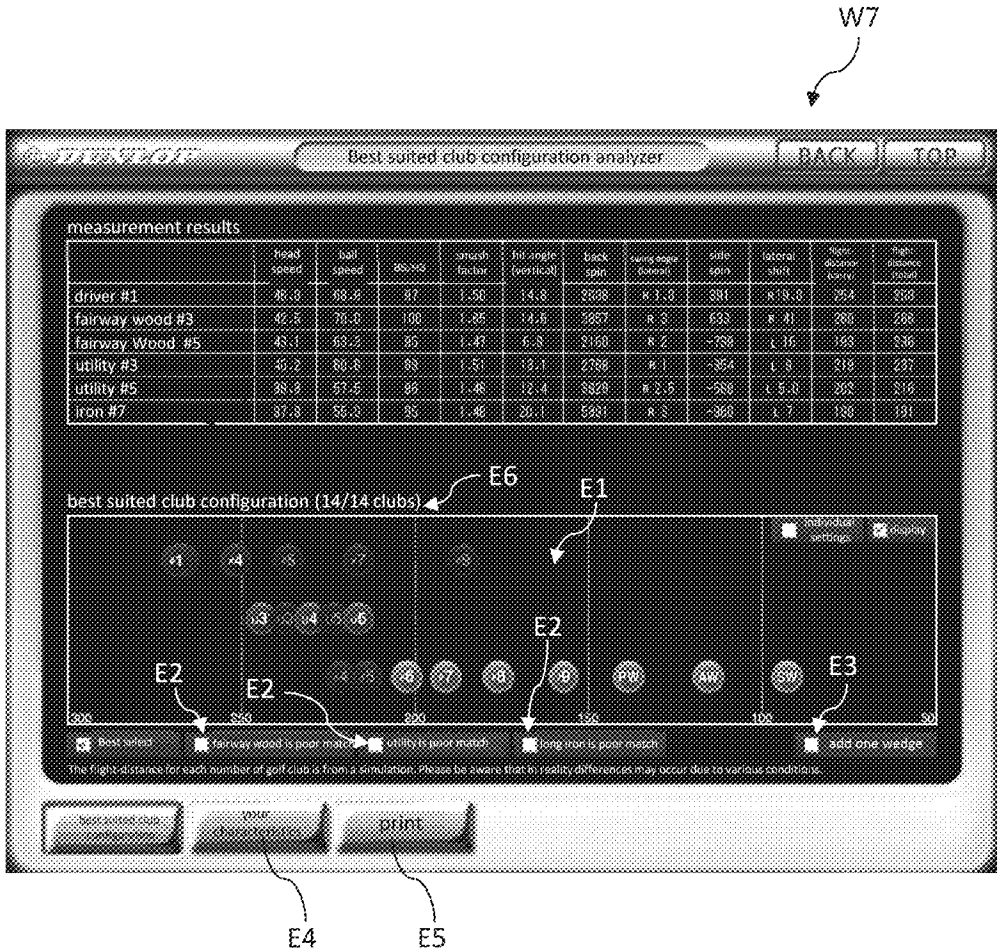
FIG. 13 is a diagram showing a screen that expresses a fitting result.

After a golf club set suited to the golfer 7 has been selected according to the above description, the display control unit 24A displays a screen W7 as shown in FIG. 13 on the display unit 21. The screen W7 is a screen that displays the selected golf club set (types and numbers). In the example of FIG. 13, the selected golf club set is expressed graphically using icons or the like in an area E1 on the screen W7. Furthermore, the number of golf clubs included in the selected golf club set is also expressed as a numerical value in an area E6 on the screen W7.

In a case where, while the screen W7 is being displayed, there is a wood, utility or iron that is a poor-match for the user, the user can perform input to this effect to the fitting device 2 and recalculate the golf club set. Specifically, the settings unit 24B receives selection of any one of the woods, utilities, and irons as a poor-match type using the selection buttons E2 at the lower area of the screen W7. Here, when any of the woods, utilities, and irons is selected, the procedure returns to step S10 and the types no. 1 through no. 3 are recalculated. Specifically, the type selected as a poor-match type on the screen W7 is moved down to the no. 3 type, and along with this the remaining types are moved up as appropriate. After this, step S11 is also executed again based on the best-match order after recalculation.

Furthermore, in a case where, while the screen W7 is being displayed, the user would like to have two SW clubs, the user can perform input to this effect to the fitting device 2 and recalculate the golf club set. Specifically, the settings unit 24B receives selection of this using a selection button E3 at a lower right side of the screen W7. Then, when the selection button E3 is selected by the user, the procedure returns to step S11, and step S11 is executed again after the number of golf clubs that have not been established is reduced by one (in the present embodiment, from five clubs to four clubs).

Figure 14:
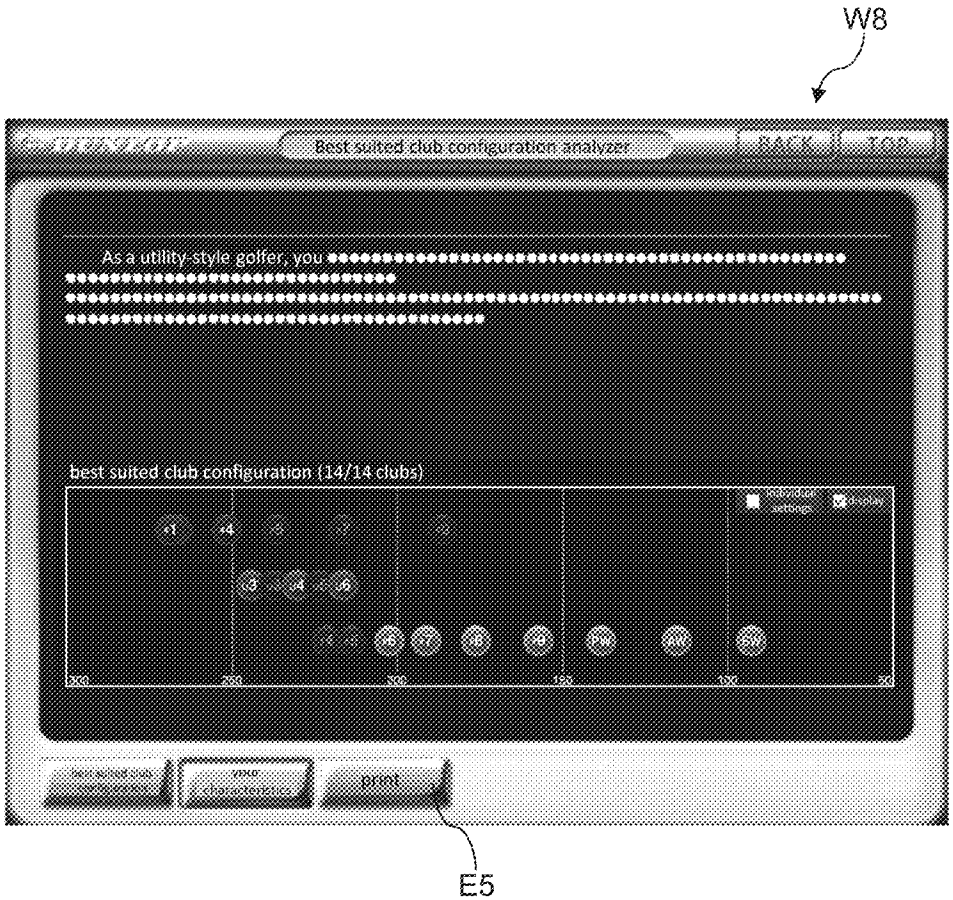
FIG. 14 is a diagram showing another screen that expresses a fitting result.

Furthermore, a "your characteristics" button E4 is displayed on the screen W7. When the button E4 is pressed by the user, the display control unit 24A displays a screen W8 as shown in FIG. 14 on the display unit 21 (step S12). The screen W8 displays in words and diagrams and the like the selected golf club set as well as information indicating the no. 1 type of club, and information indicating the characteristics of the golfer 7. It should be noted that the screens W7 and W8, which show the results of fitting in FIG. 13 and FIG. 14, are printed out by the print control unit 24G when the user presses a print button E5.

5. Features

In the above-described embodiment, comparisons are performed of the flight-distance with respect to the loft angle among the woods, utilities, and irons, and the type of golf club whose flight-distance is greatest with respect to the loft angle is determined as the best-match type of the golfer 7. Here, in general, the golf club length becomes longer for smaller loft angles of the golf club and thus more difficult to handle. Accordingly, a large flight-distance with respect to the loft angle signifies that the flight-distance is extended regardless of the handling being difficult, and therefore in the above-described embodiment, the type that achieves such a flight-distance with respect to the loft angle is determined to be the best-match type of the golfer 7. In other words, if there is the same level of difficulty, that is, the same loft angle, the type of golf club having the most extended flight-distance is determined as the best-match. Thus, here, which of the woods, utilities, and irons is a best-match for the golfer 7 is determined quantitatively, and this can assist in the selection of a set of golf clubs suited to the golfer 7.

6. Modified Examples

Above, description was given regarding one embodiment of the present invention, but the present invention is not limited to the foregoing embodiment, and various modifications are possible within a scope that does not depart from the purport thereof. For example, the following modifications are possible. Furthermore, the purport of the following modified examples can be combined as appropriate.

6-1

The essential elements are not limited to those above. In particular, the essential elements can be changed for use by males and for use by females. In this case, the settings unit 24B receives input of gender information as to whether the golfer 7 is male or female, and modifies the essential elements based on this gender information before executing the fitting process.

6-2

The types of measurements are not limited to those above, and for example there may be a type by which it is possible to have test-hits of multiple irons, and the number of clubs for test-hits of woods and/or utilities may be one club or three or more clubs. Furthermore, it is possible to arrange this such that there is only one type of measurement and selection is not allowed.

6-3

The types of golf clubs to be customized for the golfer 7 are not limited to combinations of woods, utilities, and irons. Which type is targeted for customization may be set as required in response to conditions such as the lineup of golf clubs or which are the essential elements or the like.

6-4

In the foregoing embodiment, information of the no 0.1 type is presented to the user at step S12, but it is also possible to configure this such that the information is used only in internal processing of the fitting device 2 at step S11 and not presented to the user. Alternatively, this may be configured such that step S11 is omitted and a specific golf club set is not calculated by the fitting device 2. In this case, the user is made known of the no. 1 through no. 3 types at step S12 (a most appropriate golf club set is not displayed however), and is able to select his or her own golf club set while referencing this information.

The invention claimed is:

1. A golf club set fitting device for assisting selection of a golf club set suited to a golfer from among different types of golf clubs, each type of golf club including at least one golf club identified by a number, the golf club set fitting device including a control unit and a storage unit storing a computer program that when executed by the control unit operates as:

an obtaining unit configured to obtain measurement data in which the golfer has performed a test-hit of the at least one golf club identified by the number for each type of golf club from among the different types of golf clubs, wherein woods, utilities, and irons are included in the types of golf clubs, a specifying unit configured to specify a relationship of correspondence between a loft angle and a flight-distance for each type of golf club based on the measurement data, and a determination unit configured to determine, based on the relationship of correspondence, a type of golf club having a large flight-distance with respect to a loft angle as a best-match type, which is a type of golf club best matched to the golfer.

2. The golf club set fitting device according to claim 1, further comprising the control unit when executing the computer program further operates as:

a decision unit configured to decide a golf club that is to be included in the golf club set by giving priority to the best-match type golf clubs from among the different types of golf clubs.

3. The golf club set fitting device according to claim 2, wherein:

the specifying unit is configured to specify the relationship of correspondence for each type of golf club based on the measurement data by specifying the flight-distances by various numbers of golf clubs having different loft angles, and the decision unit, based on the relationship of correspondence, in a case where multiple golf clubs are present that give flight of an equivalent flight-distance, is configured to decide a golf club that is to be included in the golf club set so that the best-match type golf club among the multiple golf clubs is given priority.

4. The golf club set fitting device according to claim 3, wherein:

the measurement data includes data in which the golfer has performed test-hits of multiple numbers of golf clubs for a specific type of golf club, and the specifying unit is configured to specify the relationship of correspondence by performing simulation of flight-distances by various numbers of golf clubs having various loft angles so that the loft angle and the flight-distance are proportional for the specific type of golf club based on the measurement data.

5. The golf club set fitting device according to claim 3, wherein:

the obtaining unit, in addition to the measurement data, is configured to further obtain reference data in which the golfer has performed a test-hit of a driver, and the specifying unit is configured to specify a head speed of the driver based on the reference data, and specifies the relationship of correspondence by performing simulation of flight-distances by various numbers of golf clubs having various loft angles for a specific type of golf club based on the head speed in addition to the measurement data.

6. The golf club set fitting device according to claim 2, wherein:

the measurement data includes data in which the golfer has performed test-hits of multiple numbers of golf clubs for a specific type of golf club, and the specifying unit is configured to specify the relationship of correspondence by performing simulation of flight-distances by various numbers of golf clubs having various loft angles so that the loft angle and the flight-distance are proportional for the specific type of golf club based on the measurement data.

7. The golf club set fitting device according to claim 2, wherein:

the obtaining unit, in addition to the measurement data, is configured to further obtain reference data in which the golfer has performed a test-hit of a driver, and the specifying unit is configured to specify a head speed of the driver based on the reference data, and specifies the relationship of correspondence by performing simulation of flight-distances by various numbers of golf clubs having various loft angles for a specific type of golf club based on the head speed in addition to the measurement data.

8. The golf club set fitting device according to claim 1, wherein:

the measurement data includes data in which the golfer has performed test-hits of multiple numbers of golf clubs for a specific type of golf club, and the specifying unit is configured to specify the relationship of correspondence by performing simulation of flight-distances by various numbers of golf clubs having various loft angles so that the loft angle and the flight-distance are proportional for the specific type of golf club based on the measurement data.

9. The golf club set fitting device according to claim 1, wherein:

the obtaining unit, in addition to the measurement data, is configured to further obtain reference data in which the golfer has performed a test-hit of a driver, and the specifying unit is configured to specify a head speed of the driver based on the reference data, and specifies the relationship of correspondence by performing simulation of flight-distances by various numbers of golf clubs having various loft angles for a specific type of golf club based on the head speed in addition to the measurement data.

10. A golf club set fitting method performed by a control unit executing a computer program for assisting selection of a golf club set suited to a golfer from among different types of golf clubs, each type of golf club including at least one golf club identified by a number, the method comprising:

obtaining measurement data in which the golfer has performed a test-hit of the at least one golf club identified by the number for each type of golf club from among the different types of golf clubs wherein woods, utilities, and irons are included in the types of golf clubs, specifying a relationship of correspondence between a loft angle and a flight-distance for each type of golf club based on the measurement data, and determining, based on the relationship of correspondence, a type of golf club having a large flight-distance with respect to a loft angle as a best-match type, which is a type of golf club best matched to the golfer.

11. A non-transitory computer readable medium storing a fitting program for assisting selection of a golf club set suited to a golfer from among different types of golf clubs, each type of golf club including at least one golf club identified by a number, wherein the program when executed causes a computer to:

obtain measurement data in which the golfer has performed a test-hit of the at least one golf club identified by the number for each type of golf club from among different types of golf clubs, wherein woods, utilities, and irons are included in the types of golf clubs, specify a relationship of correspondence between a loft angle and a flight-distance for each type of golf club based on the measurement data, and determine, based on the relationship of correspondence, a type of golf club having a large flight-distance with respect to a loft angle as a best-match type, which is a type of golf club best matched to the golfer.

* * * * *